United States Patent [19]

Pai et al.

[11] 4,140,529

[45] Feb. 20, 1979

[54] CHARGE TRANSPORT OVERLAYER IN PHOTOCONDUCTIVE ELEMENT AND METHOD OF USE

[75] Inventors: Damodar M. Pai, Fairport; John F. Yanus, Webster; Milan Stolka, Fairport, all of N.Y.

[73] Assignee: Xerox Corporation, Stamford, Conn.

[21] Appl. No.: 835,602

[22] Filed: Sep. 22, 1977

[51] Int. Cl.[2] ..... G03G 5/04; G03G 13/22

[52] U.S. Cl. ..... 96/1 PC; 96/1.5 R; 96/1.6; 260/576; 260/390

[58] Field of Search ..... 96/1.5 R, 1 PC, 1.6; 252/501

[56] References Cited

U.S. PATENT DOCUMENTS

| | | | |
|---|---|---|---|
| 3,168,857 | 2/1965 | Hutto | 96/1.6 X |
| 3,312,548 | 4/1967 | Stranghan | 96/1.5 |
| 3,542,544 | 11/1970 | Seus et al. | 96/1.5 |
| 3,589,897 | 6/1971 | Fox et al. | 96/1.6 |
| 3,615,402 | 10/1971 | Rule | 96/1.6 X |
| 3,647,431 | 3/1972 | Rossi | 96/1.5 |
| 3,787,208 | 1/1974 | Jones | 96/1.5 X |
| 3,820,989 | 6/1974 | Rule et al. | 96/1.5 |
| 3,963,779 | 6/1976 | Tsukahara et al. | 96/1.5 X |
| 3,989,520 | 11/1976 | Rochlitz | 96/1.5 |
| 4,050,935 | 9/1977 | Limburg et al. | 96/1 PC |

*Primary Examiner*—Roland E. Martin, Jr.
*Attorney, Agent, or Firm*—J. J. Ralabate; A. A. Mahassel; J. P. O'Sullivan

[57] ABSTRACT

A photosensitive member having at least two electrically operative layers is disclosed. The first layer comprises a photoconductive layer which is capable of photogenerating holes and injecting photogenerated holes into a contiguous charge transport layer. The charge transport layer comprises an electrically inactive organic resinous material containing from about 10 to about 75 percent by weight of:

where $R_1$ is selected from the group consisting of an alkyl with from 1 to 12 carbon atoms and an alkyl with from 1 to 12 carbon atoms substituted by aryl groups selected from the group consisting of phenyl, maphthyl, anthryl, and biphenyl and $R_2$ is selected from the group consisting of methyl, ethyl, chloro, bromo and hydrogen. The charge transport layer while substantially non-absorbing in the spectral region of intended use is "active" in that it allows injection of photogenerated holes from the photoconductive layer, and allows these holes to be transported through the charge transport layer. This structure may be imaged in the conventional xerographic mode which usually includes charging, exposure to light and development.

61 Claims, 4 Drawing Figures

CHARGE TRANSPORT OVERLAYER IN PHOTOCONDUCTIVE ELEMENT AND METHOD OF USE

BACKGROUND OF THE INVENTION

This invention relates in general to xerography and, more specifically, to a novel photoconductive device and method of use.

In the art of xerography, a xerographic plate containing a photoconductive insulating layer is imaged by first uniformly electrostatically charging its surface. The plate is then exposed to a pattern of activating electromagnetic radiation such as light, which selectively dissipates the charge in the illuminated areas of the photoconductive insulator while leaving behind a latent electrostatic image in the non-illuminated areas. This latent electrostatic image may then be developed to form a visible image by depositing finely divided electroscopic marking particles on the surface of the photocoductive insulating layer.

A photoconductive layer for use in xerography may be a homogeneous layer of a single material such as vitreous selenium or it may be a composite layer containing a photoconductor and another material. One type of composite photoconductive layer used in xerography is illustrated by U.S. Pat. No. 3,121,006 to Middleton and Reynolds which describes a number of layers comprising finely divided particles of a photoconductive inorganic compound dispersed in an electrically insulating organic resin binder. In its present commercial form, the binder layer contains particles of zinc oxide uniformly dispersed in a resin binder and coated on a paper backing.

In the particular examples described in Middleton et al, the binder comprises a material which is incapable of transporting injected charge carriers generated by the photoconductor particles for any significant distance. As a result, with the particular material disclosed in Middleton et al patent, the photoconductor particles must be, in substantially continuous particle-to-particle contact throughout the layer in order to permit the charge dissipation required for cyclic operation. Therefore, with the uniform dispersion of photoconductor particles described in Middleton et al, a relatively high volume concentration of photoconductor, about 50 percent by volume, is usually necessary in order to obtain sufficient photoconductor particle-to-particle contact for rapid discharge. However, it has been found that high photoconductor loadings in the binder results in the physical continuity of the resin being destroyed, thereby significantly reducing the mechanical properties of the binder layer. Systems with high photoconductor loadings are often characterized as having little or no flexibility. On the other hand, when the photoconductor concentration is reduced appreciably below about 50 percent by volume, the photo-induced discharge rate is reduced, making high speed cyclic or repeated imaging difficult or impossible.

U.S. Pat. No. 3,121,007 to Middleton et al teaches another type of photoreceptor which includes a two-phase photoconductive layer comprising photoconductive insulating particles dispersed in a homogeneous photoconductive insulating matrix. The photoreceptor is in the form of a particulate photoconductive inorganic pigment broadly disclosed as being present in an amount from about 5 to 80 percent by weight. Photodischarge is said to be caused by the combination of charge carriers generated in the photoconductive insulating matrix material and charge carriers injected from the photoconductive pigment into the photoconductive insulating matrix.

U.S. Pat. No. 3,037,861 to Hoegl et al teaches that poly(N-vinylcarbazole) exhibits some long-wave length U.V. sensitivity and suggests that its spectral sensitivity can be extended into the visible spectrum by the addition of dye sensitizers. The Hoegl et al patent further suggests that other additives such as zinc oxide or titanium dioxide may also be used in conjunction with poly(N-vinylcarbazole). In the Hoegl et al patent, the poly(N-vinylcarbazole) is intended to be used as a photoconductor, with or without additive materials which extend its spectral sensitivity.

In addition to the above, certain specialized layered structures particularly designed for reflex imaging have been proposed. For example, U.S. Pat. No. 3,165,405 to Hoesterey utilizes a two-layerd zinc oxide binder structure for reflex imaging. The Hoesterey patent utilizes two separate contiguous photoconductive layers having different spectral sensitivies in order to carry out a particular reflex imaging sequence. The Hoesterey device utilizes the properties of multiple photoconductive layers in order to obtain the combined advantages of the separate photoresponse of the respective photoconductive layers.

It can be seen from a review of the conventional composite photoconductive layers cited above, that upon exposure to light, photoconductivity in the layered structure is accomplished by charge transport through the bulk of the photoconductive layer, as in the case of vitreous selenium (and other homogeneous layered modifications). In devices employing photoconductive binder structures which include inactive electrically insulating resins such as those described in the Middleton et al, U.S. Pat. No. 3,121,006, conductivity or charge transport is accomplished through high loadings of the photoconductive pigment and allowing particle-to-particle contact of the photoconductive particles. In the case of photoconductive particles dispersed in a photoconductive matrix, such as illustrated by the Middleton et al U.S. Pat. No. 3,121,007 patent, photoconductivity occurs through the generation and transport of charge carriers in both the photoconductive matrix and the photoconductive pigment particles.

Although the above patents rely upon distinct mechanisms of discharge throughout the photoconductive layer, they generally suffer from common deficiencies in that the photoconductive surface during operation is exposed to the surrounding environment, and particularly in the case of repetitive xerographic cycling where these photoconductive layers are susceptible to abrasion, chemical attack, heat and multiple exposure to light. These effects are characterized by a gradual deterioration in the electrical characteristics of the photoconductive layer resulting in the printing out of surface defects and scratches, localized areas of persistent conductivity which fail to retain an electrostatic charge, and high dark discharge.

In addition to the problems noted above, these photoreceptors require that the photoconductor comprise either a hundred percent of the layer, as in the case of the vitreous selenium layer, or that they preferably contain a high proportion of photoconductive material in the binder configuration. The requirements of a photoconductive layer containing all or a major proportion of a photoconductive material further restricts the physical characteristics of the final plate, drum or belt in that the physical characteristics such as flexibility and adhesion of the photoconductor to a supporting substrate are primarily dictated by the physical properties of the photoconductor, and not by the resin or matrix material which is preferably present in a minor amount.

Another form of a composite photosensitive layer which has also been considered by the prior art includes a layer of photoconductive material which is covered with a relatively thick plastic layer and coated on a supporting substrate.

U.S. Pat. No. 3,041,166 to Bardeen describes such a configuration in which a transparent plastic material overlies a layer of vitreous selenium which is contained on a supporting substrate. In operation, the free surface of the transparent plastic is electrostatically charged to a given polarity. The device is then exposed to activating radiation which generates a hole-electron pair in the photoconductive layer. The electrons move through the plastic layer and neutralize positive charges on the free surface of the plastic layer thereby creating an electrostatic image. Bardeen, however, does not teach any specific plastic materials which will function in this manner, and confines his examples to structures which use a photoconductor material for the top layer.

French Pat. No. 1,577,855 to Herrick et al describes a special purpose composite photosensitive device adapted for reflex exposure by polarized light. One embodiment which employs a layer of dichroic organic photoconductive particles arrayed in oriented fashion on a supporting substrate and a layer of poly(N-vinylcarbazole) formed over the oriented layer of dichroic material. When charged and exposed to light polarized perpendicular to the orientation of the dichroic layer, the oriented dichroic layer and poly(N-vinylcarbazole) layer are both substantially transparent to the initial exposure light. When the polarized light hits the white background of the document being copied, the light is depolarized, reflected back through the device and absorbed by the dichroic photoconductive material. In another embodiment, the dichroic photoconductor is dispersed in oriented fashion throughout the layer of poly(N-vinylcarbazole).

The Shattuck et al, U.S. Pat. No. 3,837,851, discloses a particular electrophotographic member having a charge generation layer and a separate charge transport layer. The charge transport layer comprises at least one tri-aryl pyrazoline compound. These pyrazoline compounds may be dispersed in binder material such as resins known in the art.

Cherry et al, U.S. Pat. No. 3,791,826, discloses an electrophotographic member comprising a conductive substrate, a barrier layer, an inorganic charge generation layer and an organic charge transport layer comprising at least 20 percent by weight trinitrofluorenone.

Gilman, Defensive Publication of Ser. No. 93,449, filed Nov. 27, 1970, published in 888 O.G. 707 on July 20, 1970, Defensive Publication No. P888.013, U.S. Cl. 96/1.5, discloses that the speed of an inorganic photoconductor such as amorphous selenium can be improved by including an organic photoconductor in the electrophotographic element. For example, an insulating resin binder may have $TiO_2$ dispersed therein or it may be a layer of amorphous selenium. This layer is overcoated with a layer of electrically insulating binder resin having an organic photoconductor such as 4,4'-diethylamino-2,2'-dimethyltriphenylmethane dispersed therein.

"Multi-Active Photoconductive Element", Martin A. Berwick, Charles J. Fox and William A. Light, Research Disclosure, Vol. 133; pages 38–43, May 1975, was published by Industrial Opportunities Ltd., Homewell, Havant, Hampshire, England. This disclosure relates to a photoconductive element having at least two layers comprising an organic photoconductor containing a charge-transport layer in electrical contact with an aggregate charge-generation layer. Both the charge-generation layer and the charge-transport layer are essentially organic compositions. The charge-generation layer contains a continuous, electrically insulating polymer phase and a discontinuous phase comprising a finely-divided, particulate co-crystalline complex of (1) at least one polymer having an alkylidene diarylene group in a recurring unit and (2) at least one pyrylium-type dye salt. The charge-transport layer is an organic material which is capable of accepting and transporting injected charge carriers from the charge-generation layer. This layer may comprise an insulating resinous material having 4,4'-bis(diethylamino)-2,2'-dimethyltriphenylmethane dispersed therein.

Straughan, U.S. Pat. No. 3,312,548, in pertinent part, discloses a xerographic plate having a photoconductive insulating layer comprising a composition of selenium, arsenic and a halogen. The halogen may be present in amounts from about 10 to 10,000 parts per million. This patent further discloses a xerographic plate having a support, a layer of selenium and an overlayer of a photoconductive material comprising a mixture of vitreous selenium, arsenic and a halogen.

The compound of the instant invention is represented by the formula:

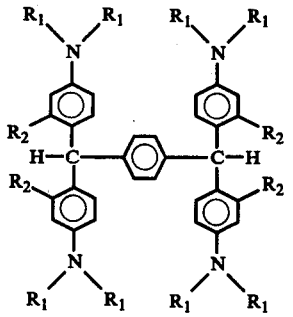

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen, is dispersed in an electrically inactive organic resinous material in order to form a charge transport layer for a multi-layered device comprising a charge generation layer and a charge transport layer. The charge transport layer must be substantially non-absorbing in the spectral region of intended use, but must be "active" in that it allows injection of photo-excited holes from the photoconductive layer, i.e., the charge generation layer, and allows these holes to be transported through the charge transport layer.

Another consideration which is necessary in the system is the glass transition temperature ($T_g$). The ($T_g$) of the transport layer has to be substantially higher than the normal operating temperatures. Many organic charge transporting layers using active materials dispersed in organic binder material have unacceptable low ($T_g$) at loadings of the active material in the organic binder material which is required for efficient charge transport. This results in the softening of the matrix of the layer and, in turn, becomes susceptible to impaction of dry developers and toners. Another unacceptable feature of a low ($T_g$) is the case of leaching or exudation of the active materials from the organic binder material resulting in degradation of charge transport properties from the charge transport layer. In addition to the above deficiencies in the low ($T_g$) layers there are increased diffusing rates of the small molecules resulting in their crystallization.

It was found that

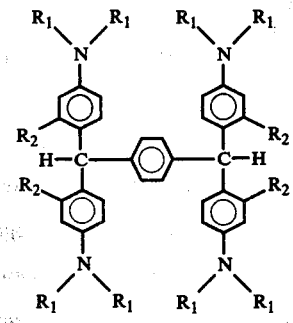

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen, dispersed in an organic binder transports charge very efficiently without any trapping when this layer is used contiguous with a generation layer and subjected to charge/light discharge cycles in an electrophotographic mode. There is no buildup of the residual potential over many thousands of cycles.

Furthermore, the transport layers comprising the active compounds of the instant invention dispersed in a binder were found to have sufficiently high ($T_g$) even at high loadings, thereby eliminating the problems associated with low ($T_g$) as discussed above.

The active compound of the instant invention will not crystallize from the transport layers even at relatively high loadings.

The active compound of the instant invention, because of their molecular weight and consequently low diffusion rate, can be used with liquid developers in xerographic reproduction machines. This is true since the liquid developers will not leach out the active compounds of the instant invention from the transport layers.

None of the above-mentioned art overcomes the above-mentioned problems. Furthermore, none of the above-mentioned art discloses specific charge generating material in a separate layer which is overcoated with a charge-transport layer comprising an electrically insulating resinous matrix material comprising an electrically inactive resinous material having dispersed therein the active compounds of the instant invention. The charge transport material is substantially non-absorbing in the spectral region of intended use, but is "active" in that it allows injection of photogenerated holes from the charge generation layer and allows these holes to be transported therethrough. The charge-generating layer is a photoconductive layer which is capable of photogenerating and injecting photogenerated holes into the contiguous charge-transport layer.

It has also been found that when an alloy of selenium and arsenic containing a halogen is used as a charge carrier generation layer in a multilayered device which contains a contiguous charge carrier transport layer, the member, as a result of using this particular charge generation layer, has unexpectedly high contrast potentials as compared to similar multilayered members employing other generating layers. Contrast potentials are important characteristics which determine print density.

STATEMENT OF PRIOR ART

Belgium Pat. No. 763,450, issued Aug. 26, 1971 (same as U.S. application Ser. No. 94,139, filed Dec. 1, 1970, now abandoned, and British Pat. No. 1,337,228, published Nov. 14, 1973). This patent discloses an electrophotographic member having at least two electrically operative layers. The first layer comprises a photoconductive layer which is capable of photogenerating charge carriers and injecting the photogenerated holes into a contiguous active layer. The active layer comprises a transparent organic material which is substantially non-absorbing in the spectral region of intended use, but which is "active" in that it allows injection of photogenerated holes from the photoconductive layer, and allows these holes to be transported to the active layer. The active polymers may be mixed with inactive polymers or non-polymeric material.

OBJECTS OF THE INVENTION

It is an object of this invention to provide a novel imaging system.

It is a further object of this invention to provide a novel photoconductive device adapted for cyclic imaging which overcomes the above-noted disadvantages.

It is a further object of this invention to provide a photoconductive member comprising a generating layer and a charge transport layer comprising an electrically inactive resinous material having dispersed therein

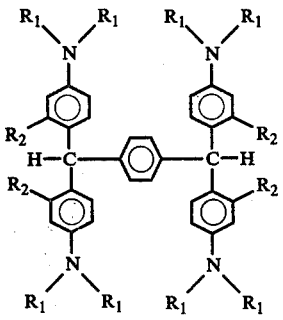

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen.

It is another object of this invention to provide a novel imaging member capable of remaining flexible while still retaining its electrical properties after extensive cycling and exposure to the ambient, i.e., oxygen, ultraviolet radiation, elevated temperatures, etc.

It is another object of this invention to provide a novel imaging member which has no bulk trapping of charge upon extensive cycling.

SUMMARY OF THE INVENTION

The foregoing objects and others are accomplished in accordance with this invention by providing a photoconductive member having at least two operative layers. The first layer comprises a layer of photoconductive material which is capable of photogenerating and injecting photogenerated holes into a contiguous or adjacent electrically active layer. The electrically active material comprises an electrically inactive resinous material having dispersed therein from about 10 to about 75 percent by weight of

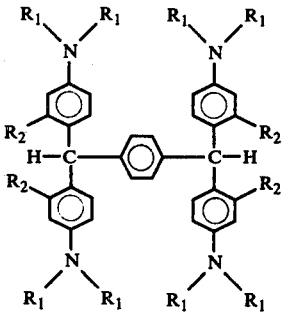

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo, and hydrogen. The more preferred active compounds are 1,4-bis-[bis-[4-bis-(phenylmethyl)-amino-2'-methylphenyl] methyl] benzene with the formula

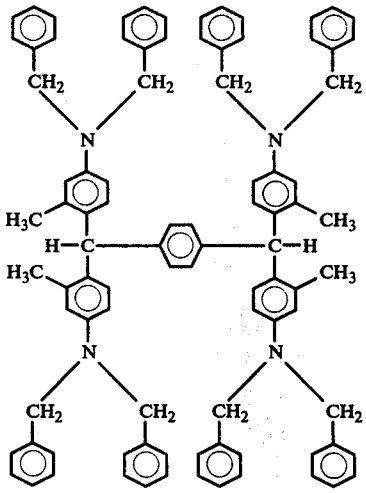

and 1,4-bis-[bis-[4-diethylamino-2'-methylphenyl]-methyl] benzene with the formula

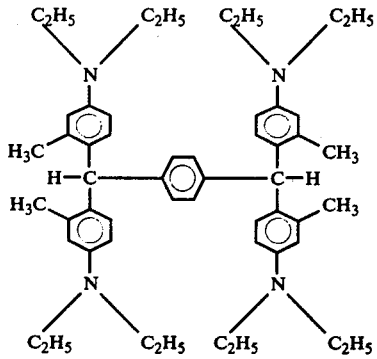

The active overcoating layer, i.e., the charge transport layer, is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

When the term "active compounds" is used herein, it refers to the following compounds:

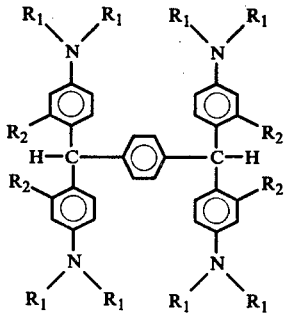

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen.

The more preferred active compounds are 1,4-bis-[bis-[4'-bis-(phenylmethyl)-amino-2'-methylphenyl]-methyl] benzene with the formula

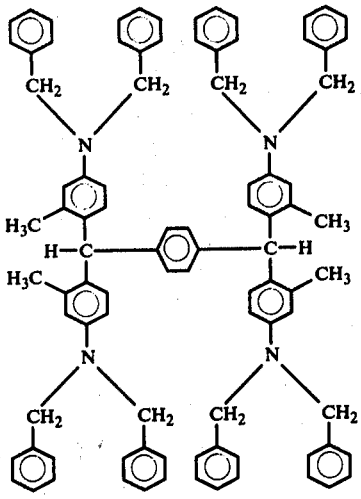

and 1,4-bis-[bis-[4'-diethylamino-2'-methylphenyl]-methyl] benzene with the formula

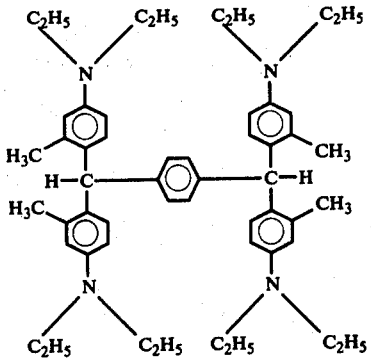

It was found that, unlike the prior art, when the active compounds of the instant invention were dispersed in an organic binder this layer transports charge very efficiently without any trapping of charges when this layer is used contiguous a generator layer and subjected to charge/light discharge cycles in an electrophotographic mode.

Furthermore, the transport layers comprising the active compounds of the instant invention dispersed in a binder were found to have sufficiently high ($T_g$) even at high loadings thereby eliminating the problems associated with low ($T_g$). The prior art suffers from this deficiency.

Furthermore, no deterioration in charge transport was observed when these transport layers containing the active compounds of the instant invention dispersed in a binder were subjected to ultraviolet radiation encountered in its normal usage in a xerographic machine environment.

Therefore, when members containing charge transport layers comprising electrically inactive resinous material having the active compounds of the instant invention are exposed to ambient conditions, i.e., oxygen, U.V. radiation, etc., these layers remain stable and do not lose their electrical properties. Furthermore, the active compounds of the instant invention do not crystallize and become insoluble in the electrically inactive resinous material into which these materials were originally dispersed. Therefore, since the active compounds of the instant invention do not appreciably react with oxygen or are not affected by U.V. radiation, normally encountered in their normal usage in a xerographic machine environment, the charge transport layer comprising an electrically inactive resinous material having the active compound of the instant invention dispersed therein allow acceptable injection of photogenerated holes from the photoconductor layer, i.e., charge generation layer, and allow these holes to be transported repeatedly through the active layer sufficiently to acceptably discharge a surface charge on the free surface of the active layer in order to form an acceptable electrostatic latent image.

As mentioned, the foregoing objects and others may be accomplished in accordance with this invention by providing a specifically preferred photoconductive member having at least two operative layers. The first layer being a most preferred specie which consists essentially of a mixture of amorphous selenium, arsenic and a halogen. Arsenic is present in amounts from about 0.5 percent to about 50 percent by weight and the halogen is present in amounts from about 10 to about 10,000 parts per million with the balance being amorphous selenium. This layer is capable of photogenerating and injecting photogenerated holes into a contiguous or adjacent charge transport layer. The charge transport layer consists essentially of an electrically inactive resinous material having dispersed therein from about 10 to about 75 percent by weight of the active compounds of the instant invention.

"Electrically active" when used to define active layer 15 means that the material is capable of supporting the injection of photogenerated holes from the generating material and capable of allowing the transport of these holes through the active layer in order to discharge a surface charge on the active layer.

"Electrically inactive" when used to describe the organic material which does not contain any of the active compounds of the instant invention means that the material is not capable of supporting the injection of photogenerated holes from the generating material and is not capable of allowing the transport of these holes through the material.

It should be understood that the electrically inactive resinous material which becomes electrically active when it contains from about 10 to about 75 percent by weight of the active compounds of this invention does not function as a photoconductor in the wavelength region of intended use. As stated above, hole-electron pairs are photogenerated in the photoconductive layer and the holes are then injected into the active layer and hole transport occurs through this active layer.

A typical application of the instant invention involves the use of a layered configuration member which in one embodiment consists of a supporting substrate such as a conductor containing a photoconductive layer thereon. For example, the photoconductive layer may be in the form of amorphous, vitreous or trigonal selenium or alloys of selenium such as selenium-arsenic, selenium-tellurium-arsenic and selenium-tellurium. A charge transport layer of electrically inactive resinous material, e.g, polycarbonates having dispersed therein from about 10 percent to about 75 percent by weight of 1,4-bis-[bis-[4'-bis-(phenylmethyl)-amino-2'-methylphenyl]-methyl] benzene which allows for hole injection and transport is coated over the selenium photoconductive layer. Generally, a thin interfacial barrier or blocking layer is sandwiched between the photoconductive layer and the substrate. The barrier layer may comprise any suitable electrically insulating material such as metallic oxide or organic resin. The use of the polycarbonate containing the active compounds of this invention allow one to take advantage of placing a photoconductive layer adjacent to a supporting substrate and protecting the photoconductive layer with a top surface which will allow for the transport of photogenerated holes from the photoconductor, and at the same time function to physically protect the photoconductive layer from environmental conditions. This structure can then be imaged in the conventional xerographic manner which usually includes charging, optical projection exposure and development.

As mentioned, when an alloy of selenium and arsenic containing a halogen of the instant invention is used as a charge carrier generation layer in a multilayered device which contains a contiguous charge carrier transport layer, the member, as a result of using this particular charge generation layer has unexpectedly high contrast potentials as compared to similar multilayered members using different generator layer materials.

A comparision is made between a 60 micron thick single layer photoreceptor member containing 64.5 percent by weight amorphous selenium, 35.5 percent by weight arsenic and 850 parts per million iodine and a multilayer member of the instant invention. The instant invention member used in the comparison is a multilayered device with a 0.2 micron thick charge generation layer of 35.5 percent by weight arsenic, 64.5 percent by weight amorphous selenium and 850 parts per million iodine. This charge generation layer is overcoated with a 30 micron thick charge transport layer of Makrolon®, a polycarbonate resin, which has dispersed therein 40 percent by weight 1,4-bis-[bis-[4-bis-(phenylmethyl)-amino-2'-methylphenyl]methyl] benzene.

The members are tested by the constant current charging mode. This is where the same amount of charge is placed on each member being tested. The multilayered device of the instant invention shows that its contrast potentials are over 60 percent more than those in the 60 micron thick single layer photorecptor.

The members are tested by the constant voltage charging mode. This is where the same amount of voltage is placed across the member. The multilayered device of the instant invention shows that the xerographic sensitivity of this device is about 30 percent higher than the xerographic sensitivity in the 60 micron thick single layer member.

From the above, it is clear that unexpectedly, the xerographic sensitivities of the mutilayered devices of the instant invention are much higher than the xerographic sensitivities of the 60 micron thick single layered member.

In general, the advantages of the improved structure and method of imaging will become apparent upon consideration of the following disclosure of the invention, especially when taken in conjunction with the accompanying drawings wherein:

DETAILED DESCRIPTION OF THE DRAWINGS

Figure 1:
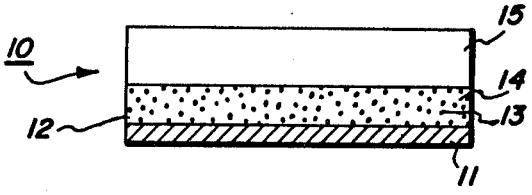
FIG. 1 is a schematic illustration of one embodiment of a device of the instant invention.

FIG. 1 designates imaging member 10 in the form of a plate which comprises a supporting substrate 11 having a binder layer 12 thereon, and a charge transport layer 15 positioned over binder layer 12. Substrate 11 is preferably made up of any suitable conductive material. Typical conductors include aluminum, steel, brass, graphite, dispersed conductive salts, conductive polymers or the like. The substrate may be rigid or flexible and of any conventional thickness. Typical substrates include flexible belts or sleeves, sheets, webs, plates, cylinders and drums. The substrate or support may also comprise a composite structure such as a thin conductive layer such as aluminum or copper iodide, or glass coated with a thin conductive coating of chromium or tin oxide. Particularly preferred are substrates of metalized polyesters, such as Mylar.

In addition, if desired, an electrically insulating substrate may be used. In this instance, the charge may be placed upon the insulating member by double corona charging techniques well known and disclosed in the art. Other modifications using an insulating substrate or no substrate at all include placing the imaging member on a conductive backing member or plate and charging the surface while in contact with said backing member. Subsequent to imaging, the imaging member may then be stripped from the conductive backing.

Binder layer 12 contains photoconductive particles 13 dispersed randomly without orientation in binder 14. The photoconductive particles may consist of any suitable inorganic or organic photoconductor and mixtures thereof. Inorganic materials include inorganic crystalline photoconductive compounds and inorganic photoconductive glasses. Typical inorganic crystalline compounds include cadmium sulfoselenide, cadmium selenide, cadmium sulfide and mixtures thereof. Typical inorganic photoconductive glasses include amorphous selenium and selenium alloys such as selenium-tellurium, selenium-tellurium-arsenic and selenium-arsenic and mixtures thereof. Selenium may also be used in a crystalline form known as trigonal selenium. A method of making a photosensitive imaging device utilizing trigonal selenium comprises vacuum evaporating a thin layer of vitreous selenium onto a substrate, forming a relatively thicker layer of electrically active organic material over said selenium layer, followed by heating the device to an elevated temperature, e.g., 125° C. to 210° C., for a sufficient time, e.g, 1 to 24 hours, sufficient to convert the vitreous selenium to the crystalline trigonal form. Another method of making a photosensitive member which utilizes trigonal selenium comprises forming a dispersion of finely divided vitreous selenium particles in a liquid organic resin solution and then coating the solution onto a supporting substrate and drying to form a binder layer comprising vitreous selenium particles contained in an organic resin matrix. Then the member is heated to an elevated temperature, e.g., 100° C. to 140° C. for a sufficient time, e.g., 8 to 24 hours, which converts the vitreous selenium to the crystalline trigonal form.

Typical organic photoconductive material which may be used as charge generators include phthalocyanine pigment such as the X-form of metal-free phthalocyanine described in U.S. Pat. No. 3,357,989 to Byrne et al; metal phthalocyanines such as copper phthalocyanine; quinacridones available from DuPont under the tradename Monastral Red, Monastral Violet and Monastral Red Y; substituted 2,4-diamino-triazines disclosed by Weinberger in U.S. Pat. No. 3,445,227; triphenodioxazines disclosed by Weinberger in U.S. Pat. No. 3,442,781; polynuclear aromatic quinones available from Allied Chemical Corporation under the tradename Indofast Double Scarlet, Indofast Violet Lake B, Indofast Brilliant Scarlet and Indofast Orange.

Intermolecular charge transfer complexes such as a mixture of poly(N-vinylcarbazole) (PVK) and trinitrofluorenone (TNF) may be used as charge generating materials. These materials are capable of injecting photogenerated holes into the transport material.

Additionally, intramolecular charge transfer complexes, such as those disclosed in Limburg et al, U.S. patent applications Ser. No. 454,484, filed Mar. 25, 1974, now abandoned; Ser. No. 454,485, filed Mar. 25, 1974, now abandoned; Ser. No. 454,486, filed Mar. 25, 1974, now abondoned; Ser. No. 454,487, filed Mar. 25, 1974, now abandoned; Ser. No. 374,157, filed June 27, 1973, now abandoned; and Ser. No. 374,187, filed June 27, 1973, now abandoned; may be used as charge generation materials capable of injecting photogenerated holes into the transport materials.

One of the most preferred embodiments is a 0.2 micron thick charge generation layer of 35.5 percent by weight arsenic, 64.5 percent by weight amorphous selenium and 850 parts per million iodine. This charge generation layer may be overcoated with a 30 micron thick charge transport layer of Makrolon ®, a polycarbonate resin, which has dispersed therein 40 percent by weight of the active compounds of the instant invention.

The above list of photoconductors should in no way be taken as limiting, but merely illustrative as suitable materials. The size of the photoconductive particles is not particularly critical; but particles in a size range of about 0.01 to 5.0 microns yield particularly satisfactory results.

Binder material 14 may comprise any electrically insulating resin such as those described in the above-mentioned Middleton et al, U.S. Pat. No. 3,121,006. When using an electrically inactive or insulating resin, it is essential that there be particle-to-particle contact between the photoconductive particles. This necessitates that the photoconductive material be present in an amount of at least about 10 percent by volume of the binder layer with no limitation on the maximum amount of photoconductor in the binder layer. If the matrix or binder comprises an active material, the photoconductive material need only to comprise about 1 percent or less by volume of the binder layer with no limitation on the maximum amount of the photoconductor in the binder layer. The thickness of the photoconductive layer is not critical. Layer thicknesses from about 0.05 to 20.0 microns have been found satisfactory, with a preferred thickness of about 0.2 to 5.0 microns yielding good results.

Another embodiment is where the photoconductive material may be particles of amorphous selenium-arsenic-halogen as shown as particles 13 which may comprise from about 0.5 percent to about 50 percent by weight arsenic and the halogen may be present in amounts from about 10 to 10,000 parts per million with the balance being amorphous selenium. The arsenic preferred may be present from about 20 percent to about 40 percent by weight with 35.5 percent by weight being the most preferred. The halogen preferably may be iodine, chlorine or bromine. The most preferred halogen is iodine. The remainder of the alloy or mixture is preferably selenium.

Active layer 15 comprises a transparent electrically inactive organic resinous material having dispersed therein from about 10 to 75 percent by weight of

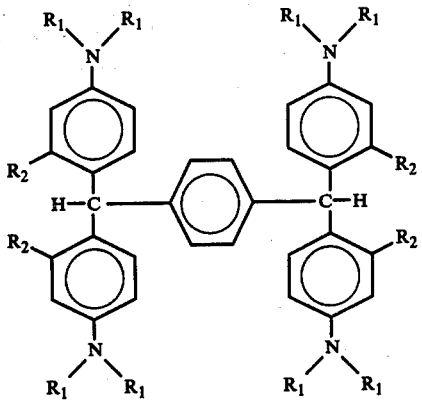

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen. The addition of active compounds of the instant invention to the electrically inactive organic resinous material forms the charge transport layer and results in the charge transport layer being capable of supporting the injection of photogenerated holes from the photoconductive layer and allowing the transport of these holes through the organic layer to selectively discharge a surface charge. Therefore, active layer 15 must be capable of supporting the injection of photogenerated holes from the photoconductive layer and allowing the transport of these holes sufficiently through the active layer to selectively discharge the surface charge.

In general, the thickness of active layer 15 should be from about 5 to 100 microns, but thicknesses outside this range can also be used.

Active layer 15 may comprise any transport electrically inactive resinous material such as those described in the above-mentioned Middleton et al. U.S. Pat. No. 3,121,006, the entire contents of which is hereby incorporated herein by reference. The electrically inactive organic material also contains at least 15 percent by weight of

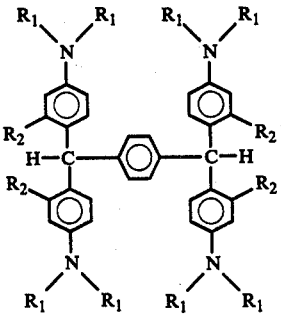

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, brom and hydrogen. Preferably the amount of active compound contained in the electrically inactive resinous material is from about 10 percent to about 75 percent by weight.

As mentioned, the more preferred active compounds are 1,4-bis-[bis-[4'-bis-(phenylmethyl)-amino-2'-methylphenyl]methyl] benzene with the formula

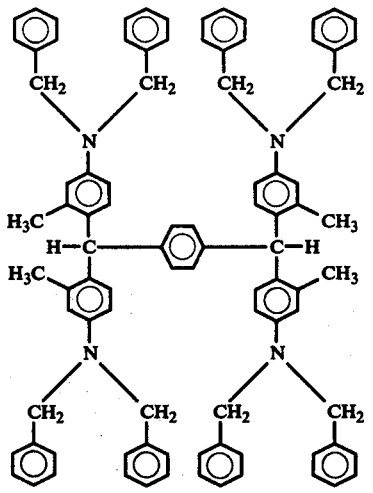

and 1/4-bis-[bis-[4'-diethylamino-2'-methylphenyl]-methyl] benzene with the formula

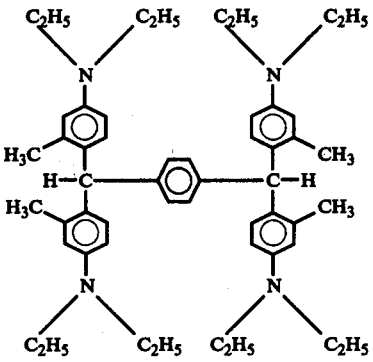

Active layer 15 must be capable of supporting the injection of photogenerated holes from the photoconductive layer and allowing the transport of these holes through the organic layer to selectively discharge the surface charge. Typical electrically inactive organic materials may comprise polycarbonates, acrylate polymers, vinyl polymers, cellulose polymers, polyesters, polysiloxanes, polyamides, polyurethanes and epoxy resins, as well as block, random, alternating or graft copolymers. In addition to Middleton et al, U.S. Pat. No. 3,121,006, an extensive list of suitable electrically inactive resinous materials are disclosed in U.S. Pat. No. 3,870,516, the entire contents of which is hereby incorporated by reference herein.

The preferred electrically inactive resinous material are polycarbonate resins. The preferred polycarbonate resins have a molecule weight (Mw) from about 20,000 to about 120,000, more preferably from about 50,000 to about 120,000.

The materials most preferred as the electrically inactive resinous material is poly(4,4'-isopropylidene-diphenylene carbonate) with a molecular weight (Mw) of from about 35,000 to about 40,000, available as Lexan® 145 from General Electric Company; poly(4,4'-isopropylidene-diphenylene carbonate) with a molecular weight (Mw) of from about 40,000 to about 45,000, available as Lexan® 141 from the General Electric Company; a polycarbonate resin having a molecular weight (Mw) of from about 50,000 to about 120,000 available as Makrolon® from Farbenfabricken Bayer A. G. and a polycarbonate resin having a molecular weight (Mw) of from about 20,000 to about 50,000 available as Merlon® from Mobay Chemical Company.

Figure 2:
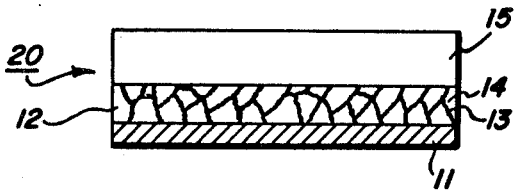
FIG. 2 illustrates a second embodiment of the device for the instant invention.

In another embodiment of the instant invention, the structure of FIG. 1 is modified to insure that the photoconductive particles are in the form of continuous chains through the thickness of binder layer 12. This embodiment is illustrated by FIG. 2 in which the basic structure and materials are the same as those in FIG. 1, except the photoconductive particles are in the form of continuous chains. Layer 14 of FIG. 2 more specifically may comprise photoconductive materials in a multiplicity of interlocking photoconductive continuous paths through the thickness of layer 14, the photoconductive paths being present in a volume concentration based on the volume of said layer, of from about 1 to 25 percent.

A further alternative for layer 14 of FIG. 2 comprises photoconductive material in substantial particle-to-particle contact in the layer in a multiplicity of interlocking photoconductive paths through the thickness of said member, the photoconductive paths being present in a volume concentration, based on the volume of the layer, of from about 1 to 25 percent.

Alternatively, the photoconductive layer may consist entirely of a substantially homogeneous photoconductive material such as a layer of amorphous selenium, a selenium alloy or a powder or sintered photoconductive layer such as cadmium sulfoselenide or phthalocyanine. This modification is illustrated by FIG. 3 in which the photosensitive member 30 comprises a substrate 11, having a homogeneous photoconductive layer 16 with an overlying active organic transport layer 15 which comprises an electrically inactive organic resinous material having dispersed therein from about 10 to about 75 percent by weight of the active compounds of the instant invention.

Figure 3:
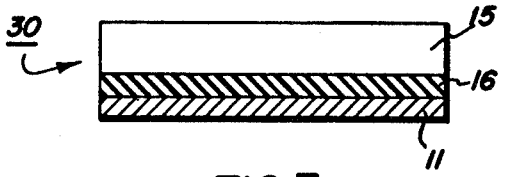
FIG. 3 illustrates a third embodiment of the device of the instant invention.
Figure 4:
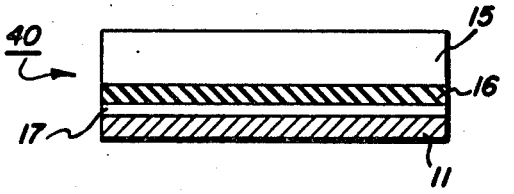
FIG. 4 illustrates a fourth embodiment of the device of the instant invention.

Another modification of the layered configuration described in FIGS. 1, 2 and 3 include the use of a blocking layer 17 at the substrate-photoconductive interface. This configuration is illustrated by photosensitive member 40 in FIG. 4 in which the substrate 11 and photosensitive layer 16 are separated by a blocking layer 17. The blocking layer functions to prevent the injection of charge carriers from the substrate into the photoconductive layer. Any suitable blocking material may be used. Typical materials include nylon, epoxy and aluminum oxide.

It should be understood that in the layered configurations described in FIGS. 1, 2, 3 and 4, the photoconductive material preferably is selected from the group consisting of amorphous selenium, trigonal selenium, selenium alloys selected from the group consisting essentially of selenium-tellurium, selenium-tellurium-arsenic, and selenium-arsenic and mixtures thereof. One of the preferred photoconductive materials is trigonal selenium.

Active layer 15, i.e., the charge transport layer, comprises an electrically inactive organic resinous material having dispersed therein from about 10 to 75 percent by weight of

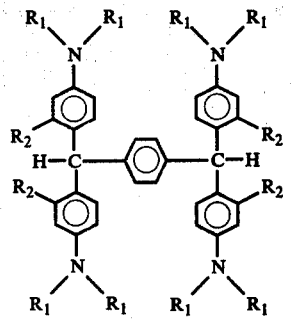

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen.

The more preferred active compounds are 1,4-bis-[bis-[4'-bis-(phenylmethyl)-amino-2'-methylphenyl]-methyl] benzene with the formula

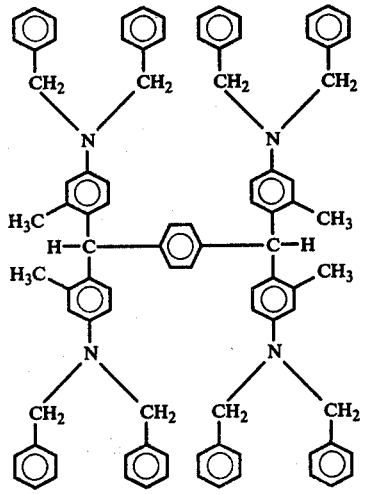

and 1,4-bis-[bis-[4'-diethylamino-2'-methylphenyl]-methyl] benzene with the formula

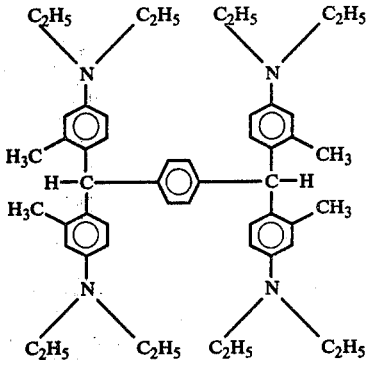

The active compounds of the instant invention are non-absorbing to light in the wavelength region of use to generate carriers in the photoconductive layer, i.e. generation layer. This preferred range for xerographic utility is from about 4,000 to about 8,000 angstrom units. In addition, the photoconductor should be responsive to all wavelengths from 4,000 to 8,000 angstrom units if panchromatic responses are required. All photoconductoractive material combination of the instant invention results in the injection and subsequent transport of holes across the physical interface between the photoconductor and the active material.

The reason for the requirement that active layer 15, i.e., charge transport layer, should be transparent is that most of the incident radiation is utilized by the charge carrier generator layer for efficient photogeneration.

Charge transport layer 15, i.e., the electrically inactive organic resinous material containing the active compounds of the instant invention will exhibit negligible, if any, discharge when exposed to a wavelength of light useful in xerography, i.e., 4,000 to 8,000 angstroms. Therefore, the obvious improvement in performance which results from the use of the two-layered systems can best be realized if the active materials, i.e., electrically inactive organic resinous material containing the active compounds of the instant invention, are substantially transparent to radiation in a region in which the photoconductor is to be used; as mentioned, for any absorption of desired radiation by the charge transport layer will prevent this radiation from reaching the photoconductive layer where it is much more effectively utilized. Therefore, the active layer which comprises an electrically inactive organic resinous material having dispersed therein from about 10 to about 75 percent by weight of the active compounds of the instant invention is a substantially non-photoconductive material in the range of from about 4,000 to 8,000Å which supports injection of photogenerated holes from the photoconductive layer. This material is further characterized by the ability to transport the carrier even at the lowest electrical fields developed in electrophotography.

The active transport layer which is employed in conjunction with the photoconductive layer in the instant invention is a material which is an insulator to the extent that the electrostatic charge placed on said active transport layer is not conducted in the absence of illumination, i.e., with a rate sufficient to prevent the formation and retention of an electrostatic latent image thereon.

In general, the thickness of the active layer preferably is from about 5 and 100 microns, but thicknesses outside this range can also be used. The ratio of the thickness of the active layer, i.e., charge transport layer, to the photoconductive layer, i.e., charge generator layer, preferably should be maintained from about 2:1 to 200:1 and in some instances as great as 400:1.

The following examples further specifically define the present invention with respect to a method of making a photosensitive member containing a photoconductive layer, i.e., charge generator layer, contiguous to an active organic layer, i.e., charge transport layer comprising an electrically inactive organic resinous material having dispersed therein from about 10 to about 75 percent by weight of the active compounds of the instant invention.

The percentages are by weight unless otherwise indicated The examples below are intended to illustrate various preferred embodiments of the instant invention.

EXAMPLE I

Preparation of 1,4-bis-[bis-[4'-bis-(phenylmethyl)-amino-2'-methylphenyl]methyl] benzene:

In a 5,000 milliliter, round bottom, 3 necked flask fitted with a mechanical stirrer and blanketed with nitrogen, is placed 14.3 grams of N,N-dibenzyl-m-toluidine and 1.65 grams of terephthalaldehyde. A solution of 0.69 grams of conc. ($H_2SO_4$) sulfuric acid in 10 ml of 1-butanol is added and the mixture refluxed for 18 hours. The mixture is allowed to cool. A sufficient amount of ($NaHCO_3$) sodium bicarbonate is added to neutralize to mixture. 100 ml of methanol is then added. The product is then filtered and washed with methanol. The product is column chromatographed using Woelm neutral alumina. The product is recrystallized from a mixture of cyclohexane and benzene. The melting point is 195° C. to 196° C. The yield is 9.3 grams (60%).

EXAMPLE II

Preparation of 1,4-bis-[bis-[4'-diethylamino-2'-methylphenyl]methyl] benzene:

In a 5,000 milliliter, round bottom, 3 necked flask fitted with a mechanical stirrer and blanketed with nitrogen, is placed 32.6 grams of N,N-diethyl-m-toluidine and 6.7 grams of terephthaladehyde. A solution of 2.8 grams of conc. ($H_2SO_4$) sulfuric acid in 40 ml of 1-butanol is added and the mixture refluxed for 18 hours. The mixture is allowed to cool. 100 ml of methanol is then added. The product is filtered and washed with methanol. The product is column chromatographed using Woelm neutral alumina. The product is recrystallized from a mixture of hexane and benzene. The melting point is 216° C. The yield is 23 grams (60%).

EXAMPLE III

A photosensitive layer structure similar to that illustrated in FIG. 3 comprises an aluminized Mylar® substrate, having a 1 micron layer of amorphous selenium over the substrate, and a 22 micron thick layer of a charge transport material comprising 25 percent by weight of 1,4-bis-[bis-[4'-bis-(phenylmethyl)-amino-2'-methylphenyl]methyl] benzene and 75 percent by weight bisphenol-A-polycarbonate (Lexan® 145, obtained from General Electric Company) over the amorphous selenium layer. The member is prepared by the following technique:

A 1 micron layer of vitreous selenium is formed over an aluminized Mylar® substrate by conventional vacuum deposition technique such as those disclosed by Bixby in U.S. Pat. Nos. 2,753,278 and 2,970,906.

A charge transport layer is prepared by dissolving in 200 grams of methylene chloride, 5 grams of 1,4-bis-[bis-[4'-bis-(phenylmethyl)-amino-2'-methylphenyl]-methyl] benzene as prepared in Example I and 15 grams of bisphenol-A-polycarbonate (Lexan® 145, obtained from General Electric Company). A layer of the above mixture is formed on the vitreous selenium layer using a Bird Film Applicator. The coating is then vacuum dried at 40° C. for 18 hours to form a 22 micron thin dry layer of charge transport material.

The above member is then heated to about 125° C. for 16 hours which is sufficient to convert the vitreous selenium to the crystalline trigonal form.

The plate is tested electrically by negatively charging the plate to a field of 60 volts/micron and discharging it at a wavelength of 4,200 angstrom units at $2 \times 10^{12}$ photons/cm$^2$ seconds. The plate exhibits satisfactory discharge at the above fields and is capable of use in forming visible images.

EXAMPLE IV

A photosensitive layer structure similar to that illustrated in Example III comprising an aluminized Mylar substrate, having a 1 micron layer of trigonal selenium over the substrate, and a 22 micron thick layer of charge transport layer comprising 50 percent by weight of 1,4-bis-[bis-[4'-diethylamino-2'-methylphenyl]methyl] benzene and 50 percent by weight bisphenol-A-polycarbonate (Lexan® 141, obtained from General Electric Company) is overcoated onto the trigonal selenium layer. The member is prepared by the following technique:

A 1 micron layer of amorphous selenium is vacuum evaporated on a 3 mil aluminum substrate by conventional vacuum deposition technique such as those disclosed by Bixby in U.S. Pat. Nos. 2,753,278 and 2,970,906. Prior to evaporating the amorphous selenium onto the substrate, a 0.5 micron layer of an epoxy-phenolic barrier layer is formed over the aluminum by dip coating. Vacuum deposition is carried out at a vacuum of $10^{-6}$ Torr while the substrate is maintained at a temperature of about 50° C. during the vacuum deposition. A 22 micron thick layer of charge transport material comprising 50 percent by weight of 1,4-bis-[bis-[4'-diethylamino-2'-methylphenyl]methyl] benzene and 50 percent by weight of poly(4,4'-isopropylidenediphenylene carbonate) having a (Mw) of about 40,000 (available as Lexan® 141 from General Electric Company) is coated over the amorphous selenium layer.

The charge transport layer is prepared by dissolving in 132 grams of methylene chloride, 10 grams of 1,4-bis-[bis-[4'-diethylamino-2'-methylphenyl]methyl] benzene as prepared in Example II and 10 grams of poly(4,4'-isopropylidene-diphenylene carbonate) (Lexan® 141, having a (Mw) of about 40,000 obtained from General Electric Company). A layer of the above mixture as mentioned above is formed on the amorphous selenium layer by using a Bird Film Applicator. The coating is then dried at 40° C. for 18 hours to form a 22 micron thick dry layer of charge transport material. The amorphous selenium layer is then converted to the crystalline trigonal form by heating the entire device to 125° C. and maintaining this temperature for about 16 hours. At the end of 16 hours, the device is cooled to room temperature. The plate is tested electrically by negatively charging the plate to fields of 60 volts/micron and discharging them at a wavelength of 4,200 angstroms at 2 $\times 10^{12}$ photons/cm$^2$ seconds. The plate exhibits satisfactory discharge at the above fields, and is capable of use in forming excellent visible images.

EXAMPLE V

A photosensitive layer structure similar to that illustrated in FIG. 3 comprises an aluminized Mylar® substrate, having a 0.2 micron layer of amorphous selenium-arsenic containing a halogen over the substrate, and a 30 micron thick layer of a charge transport material comprising 25 percent by weight of 1,4-bis-[bis-[4'-bis-(phenylmethyl)-amino-2'-methylphenyl]methyl] benzene and 75 percent by weight bisphenol-A-polycarbonate (Lexan® 145, obtained from General Electric Company) over the amorphous selenium-arsenic-halogen layer. The member is prepared by the following technique:

A mixture of about 35.5 percent by weight of arsenic and about 64.5 percent by weight of selenium and about 850 parts per million (ppm) of iodine are sealed in a Pyrex® vial and reacted at about 525° C. for about 3 hours in a rocking furnance. The mixture is then cooled to about room temperature, removed from the Pyrex® vial and placed in a quartz crucible within a bell jar. An aluminum plate is supported about 12 inches above the crucible and maintained at a temperature of about 70° C. The bell jar is then evacuated to a pressure of about 5 $\times 10^{-5}$ torr and the quartz crucible is heated to a temperature of about 380° C. to evaporate the mixture onto the aluminum plate. The crucible is kept at the evaporation temperature for approximately 30 minutes. At the end of this time the crucible is permitted to cool and the finished plate is removed from the bell jar.

A charge transport layer is prepared by dissolving in 200 grams of methylene chlorine, 5 grams of 1,4-bis-[bis-[4'-bis-(phenylmethyl)-amino-2'-methylphenyl]-methyl] benzene as prepared in Example I and 15 grams of bisphenol-A-polycarbonate (Lexan® 145, obtained from General Electric Company). A layer of the above mixture is formed on the vitreous selenium-arsenic-iodine layer using a Bird Film Applicator. The coating is then vacuum dried at 80° C. for 18 hours to form a 30 micron thin dry layer of charge transport material.

The plate is tested electrically by negatively charging the plate to a field of 60 volts/micron and discharging it at a wavelength of 4,200 angstrom units at 2 $\times 10^{12}$ photons/cm$^2$ seconds. The plate exhibits satisfactory discharge at the above fields and is capable of use in forming visible images.

EXAMPLE VI 0.328 grams of poly(N-vinylcarbazole) and 0.0109 grams of 2,4,7-trinitro-9-fluorenone are dissolved in 14 ml of benzene. 0.44 grams of submicron trigonal selenium particles are added to the mixture. The entire mixture is ball milled on a Red-Devil® paint shaker for 15 to 60 minutes in a 2 oz. amber colored glass jar containing 100 grams ⅛ inch diameter steel shot. Approximately 2 microns thick layer of the slurry is coated on an aluminized Mylar® substrate precoated with an approximately 0.5 micron Flexclad® adhesive interface which acts as a blocking layer. This member is evacuated at 100° C. for 24 hours and then slowly cooled to room temperature. The charge transport layer is prepared by dissolving 200 grams of methylene chloride, 5 grams of 1,4-bis-[bis-[4'-bis-(phenylmethyl)-amino-2'-methylphenyl]methyl] benzene as prepared in Example I and 15 grams of bisphenol-A-polycarbonate (Lexan® 145, obtained from General Electric Company). A 22 micron layer of the above mixture is coated on the trigonal selenium layer by use of a Bird Applicator. The coating is then dried at 40° C. for 18 hours.

The plate is tested electrically by charging the plate to a field of 60 volts/micron and discharging it at a wavelength of 4,200 angstrom units at 2 $\times 10^{12}$ photons/cm$^2$ seconds. The plate exhibits satisfactory discharge at the above fields and is capable of use in forming visible images.

Other modifications and ramifications of the present invention which appear to those skilled in the art upon reading of the disclosure are also intended to be within the scope of this invention.

What is claimed is:

1. An imaging member comprising a charge generation layer which comprises a layer of photoconductive material and a contiguous charge transport layer of electrically inactive organic resinous material having dispersed therein from about 10 to about 75 percent by weight of

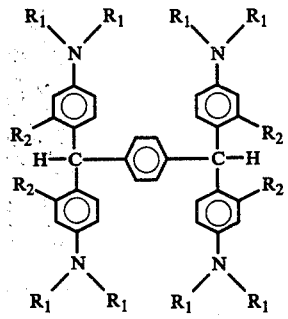

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and bisphenyl and $R_2$ is selected from the group consisting of methyl, ethyl, chloro, bromo and hydrogen. said photoconductive layer exhibiting the capability of photogeneration of holes and injection of said holes and said charge transport layer being substantially non-absorbing in the spectral region at which the photoconductive layer generates and injects photogenerated holes but being capable of supporting the injection of photogenerated holes from said photoconductive layer and transporting said holes through said charge transport layer.

2. The member according to claim 1 wherein said electrically inactive organic resinuous material has dispersed therein 1,4-bis-[bis-[4'-bis(phenylmethyl)-amino-2'-methylphenyl]methyl] benzene.

3. The member according to claim 1 wherein said electrically inactive organic resinous material has dispersed therein 1,4-bis-[bis[4'-diethylamino-2'-methylphenyl]methyl] benzene.

4. The member according to claim 1 wherein the electrically inactive organic resinous material is a polycarbonate resin.

5. The member according to claim 4 wherein the polycarbonate resin has a (Mw) of from about 20,000 to about 120,000.

6. The member according to claim 4 wherein the polycarbonate has a (Mw) of from about 20,000 to about 50,000.

7. The member according to claim 4 wherein the polycarbonate resin has a (Mw) of from about 50,000 to about 120,000.

8. The member according to claim 4 wherein the polycarbonate resin is poly(4,4'-isopropylidene-diphenylene carbonate) having a (Mw) of from about 35,000 to about 40,000.

9. The member according to claim 4 wherein the polycarbonate is poly(4,4'-isopropylidene-diphenylene carbonate) having a (Mw) of from about 40,000 to about 45,000.

10. The member according to claim 1 wherein the photoconductive material is selected from the group consisting of amorphous selenium, trigonal selenium, and selenium alloys selected from the group consisting of selenium-tellurium, selenium-tellurium-arsenic and selenium-arsenic and mixtures thereof.

11. An imaging member comprising a charge generation layer which comprises photoconductive material dispersed in a resinous binder and a contiguous charge transport layer of electrically inactive organic resinous material having dispersed therein from about 10 to about 75 percent by weight of

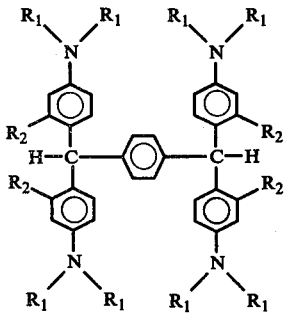

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo, and hydrogen, said photoconductive material exhibiting the capability of photogeneration of holes and injection of said holes and said charge transport layer being substantially non-absorbing in the spectral region at which the photoconductive material generates and injects photogenerated holes but being capable of supporting the injection of photogenerated holes from said photoconductive material and transport said holes through said charge transport layer.

12. The member according to claim 11 wherein said electrically inactive organic resinous material has dispersed therein 1,4-bis-[bis-[4'-bis-(phenylmethyl)-amino-2'-methylphenyl]methyl] benzene.

13. The member according to claim 11 wherein said electrically inactive organic resinous material has dispersed therein 1,4-bis-[bis-[4'-diethylamino-2'-methylphenyl]methyl] benzene.

14. The member according to claim 11 wherein the electrically inactive organic resinous material is a polycarbonate resin.

15. The member according to claim 14 wherein the polycarbonate resin has a (Mw) of from about 20,000 to about 120,000.

16. The member according to claim 10 wherein the polycarbonate resin has a (Mw) of from about 20,000 to about 50,000.

17. The member according to claim 14 wherein the polycarbonate resin has a (Mw) of from about 50,000 to about 120,000.

18. The member according to claim 10 wherein the polycarbonate resin is poly(4,4'-isopropylidene-diphenylene carbonate) having a (Mw) of from about 35,000 to about 40,000.

19. The member according to claim 14 wherein the polycarbonate resin is poly(4,4'-isopropylidene-diphenylene carbonate) having a (Mw) of from about 40,000 to about 45,000.

20. The member according to claim 11 wherein the photoconductive material is selected from the group consisting of amorphous selenium, trigonal selenium and selenium alloys selected from the group consisting of selenium-tellurium, selenium-tellurium-arsenic and selenium-arsenic and mixtures thereof.

21. The member according to claim 20 wherein the photoconductive material is trigonal selenium.

22. An imaging member comprising a charge generation layer which comprises an insulating organic resin matrix and a photoconductive material with substantially all of the photoconductive material in said layer in a multiplicity of interlocking photoconductive continuous paths through the thickness of said layer, said photoconductive paths being present in a volume concentration, based on the volume of said layer, of from about 1 to 25 percent and a contiguous charge transport layer of electrically inactive organic resinous material having dispersed therein from about 10 to 75 percent by weight of

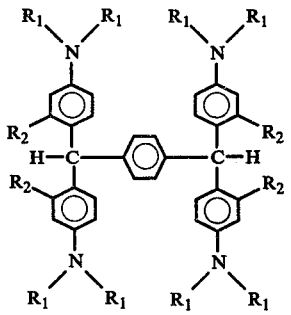

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen, said photoconductive material exhibiting the capability of photogeneration of holes and injection of said holes and said charge transport layer being substantially non-absorbing in the spectral region at which the photoconductive material generates and injects photogenerated holes but being capable of supporting the injection of photogenerated holes from said photoconductive material and transporting said holes through said charge transport layer.

23. The member according to claim 22 wherein said electrically inactive organic resinous material has dispersed therein 1,4-bis-[bis-[4'-bis-(phenylmethyl)-amino-2'-methylphenyl]methyl] benzene.

24. The member according to claim 22 wherein said electrically inactive organic resinous material has dispersed therein 1,4-bis-[bis-[4'-diethylamino-2'-methylphenyl]methyl] benzene.

25. The member according to claim 22 wherein the electrically inactive organic material is a polycarbonate resin.

26. The member according to claim 25 wherein the polycarbonate resin has a (Mw) of from about 20,000 to about 120,000.

27. The member according to claim 25 wherein the polycarbonate resin has a (Mw) of from about 20,000 to about 50,000.

28. The member according to claim 19 wherein the polycarbonate resin has a (Mw) of from about 50,000 to about 120,000.

29. The member according to claim 25 wherein the electrically inactive polycarbonate resin is poly(4,4'-isopropylidene-diphenylene carbonate) having a (Mw) of from about 35,000 to about 40,000.

30. The member according to claim 25 wherein the carbonate resin is poly(4,4'-isopropylidene-diphenylene carbonate) having a (Mw) of from about 40,000 to about 45,000.

31. The member according to claim 22 wherein the photoconductive material is selected from the group consisting of amorphous selenium, trigonal selenium and selenium alloys selected from the group consisting of selenium-tellurium, selenium-tellurium-arsenic and selenium-arsenic and mixtures thereof.

32. The member according to claim 31 wherein the photoconductive material is trigonal selenium.

33. An imaging member comprising a charge generation layer which comprises an insulating organic resin matrix containing therein photoconductive particles, with substantially all of the photoconductive particles being in substantial particle-to-particle contact in said layer in a multiplicity of interlocking photoconductive paths through the thickness of said layer, said photoconductive paths being present in a volume concentration, based on the volume of said layer, of from about 1 to 25 percent, and a contiguous charge transport layer of electrically inactive organic resinous material having dispersed therein from about 10 to about 75 percent by weight

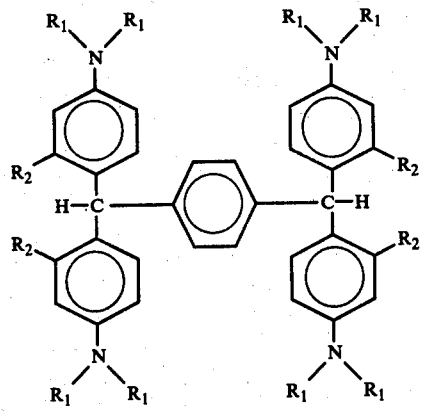

wherein $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen, said photoconductive material exhibiting the capability of photogeneration of holes and injection of said holes and said charge transport layer being substantially non-absorbing in the spectral region at which the photoconductive material generates and injects photogenerated holes, but being capable of supporting the injection of photogenerated holes from said photoconductive material and transporting said holes through said charge transport layer.

34. The member according to claim 33 wherein said electrically inactive organic resinous material has dispersed therein 1,4-bis-[bis-[4'-bis-(phenylmethyl)-amino-2'-methylphenyl]methyl] benzene.

35. The member according to claim 33 wherein said electrically inactive organic resinous material has dispersed therein 1,4-bis-[bis-[4'-diethylamino-2'-methylphenyl[methyl[ benzene.

36. The member according to claim 33 wherein the electrically inactive organic resinous material is a polycarbonate resin.

37. The member according to claim 36 wherein the polycarbonate resin has a (Mw) of from about 20,000 to about 120,000.

38. The member according to claim 36 wherein the polycarbonate resin has a (Mw) of from about 20,000 to about 50,000.

39. The member according to claim 36 wherein the polycarbonate resin has a (Mw) of from about 50,000 to about 120,000.

40. The member according to claim 36 wherein the polycarbonate resin is poly(4,4'-isopropylidene-diphenylene carbonate) having a (Mw) of from about 35,000 to about 40,000.

41. The member according to claim 36 wherein the polycarbonate resin is poly(4,4'-isopropylidene-diphenylene carbonate) having a (Mw) of from about 40,000 to about 45,000.

42. The member according to claim 33 wherein the photoconductive material is selected from the group consisting of amorphous selenium, trigonal selenium and selenium alloys selected from the group consisting of selenium-tellurium, selenium-tellurium-arsenic and selenium-arsenic and mixtures thereof.

43. The member according to claim 42 wherein the photoconductive material is trigonal selenium.

44. A method of imaging which comprises:

(a) providing an imaging member comprising a layer of photoconductive material and a contiguous charge transport layer of electrically inactive organic resinous material having dispersed therein from about 10 to about 75 percent by weight of

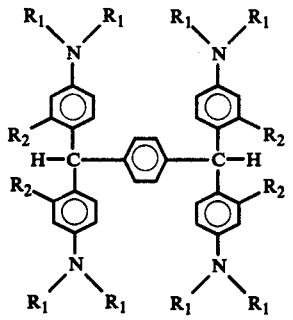

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen, said photoconductive material exhibiting the capability of photogeneration of holes and injection of said holes and said charge transport layer being substantially non-absorbing in the spectral region at which the photoconductive material generates and injects photogenerated holes but being capable of supporting the injection of photogenerated holes from said photoconductive material and transporting said holes through said charge transport layer;

(b) uniformly electrostatically charging said member, followed by;

(c) imagewise exposing said charged member to a source of activating radiation to which the photoconductive material is absorbing and to which the charge transport layer is non-absorbing, wherein the photogenerated holes generated by said photoconductive material are injected into and are transported through said charge transport layer to form a latent electrostatic image on the surface of said member.

45. The method according to claim 44 wherein said electrically inactive organic resinous material has dispersed therein 1,4-bis-[bis-[4'-bis-(phenylmethyl)-amino-2'-methylphenyl]methyl] benzene.

46. The method of according to claim 44 wherein said electrically inactive organic resinous material has dispersed therein 1,4-bis-[bis-[4'-diethylamino-2'-methylphenyl]methyl] benzene.

47. A method of imaging which comprises:

(a) providing an imaging member comprising a charge generation layer which comprises photoconductive material dispersed in a resinous binder and a contiguous charge transport layer of electrically inactive organic resinous material having dispersed therein from about 10 to about 75 percent by weight of

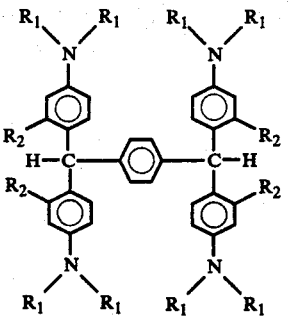

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen, said photoconductive material exhibiting the capability of photo-excited hole generation and injection and said charge transport layer being substantially non-absorbing in the spectral region at which the photoconductive material generates and injects photo-excited holes but being capable of supporting the injection of photo-excited holes from said photoconductive material and transporting said holes through said charge transport layer;

(b) uniformly electrostatically charging said member, followed by;

(c) imagewise exposing said charged member to a source of activating radiation to which the photoconductive material dispersed in a resinous binder is absorbing and to which the charge transport layer is non-absorbing, whereby the photo-excited holes generated by said photoconductive material dispersed in a binder are injected into and are transported through said charge transport layer to form a latent electrostatic image on the surface of said member.

48. The method according to claim 47 wherein said electrically inactive organic resinous material has dispersed therein 1,4-bis-[bis-[4'-bis-(phenylmethyl)-amino2'-methylphenyl]methyl] benzene.

49. The method according to claim 47 wherein said electrically inactive organic resinous material has dispersed therein 1,4-bis-[bis-[4'-diethylamino-2'-methylphenyl]methyl] benzene.

50. A method of imaging which comprises:

(a) providing an imaging member comprising a charge generation layer which comprises an insulating organic resin matrix and a photoconductive material, with substantially all of the photoconductive material in said layer in a multiplicity of interlocking photoconductive continuous paths through the thickness of said layer, said photoconductive paths being present in a volume concentration, based on the volume of said layer, of from about 1 to 25 percent and a contiguous charge transport layer of electrically inactive organic material having dispersed therein from about 10 to about 75 percent by weight of

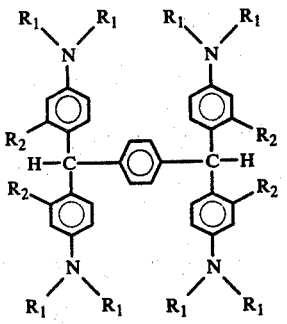

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen, said photoconductive material exhibiting the capability of photogeneration of holes and injection of said holes and said charge transport layer being substantially non-absorbing in the spectral region at which the photoconductive material generates and injects photogenerated holes but being capable of supporting the injection of photogenerated holes from said photoconductive material and transporting said holes through said charge transport layer;

(b) uniformly electrostatically charging said member, followed by;

(c) imagewise exposing said charged member to a source of activating radiation to which the photoconductive material is absorbing and to which the charge transport layer is non-absorbing, wherein the photogenerated holes generated by said photoconductive material are injected into and are transported through said charge transport layer to form a latent electrostatic image on the surface of said member.

51. A method of imaging which comprises:

(a) providing an imaging member comprising a charge generation layer which comprises an insulating organic resin matrix containing therein photoconductive particles, with substantially all of the photoconductive particles being in substantial particle-to-particle contact in said layer in a multiplicity of interlocking photoconductive continuous paths through the thickness of said layer, said photoconductive paths being present in a volume concentration, based on the volume of said layer, of from about 1 to 25 percent and a contiguous charge transport layer of electrically inactive organic material having dispersed therein from about 10 to about 75 percent by weight of

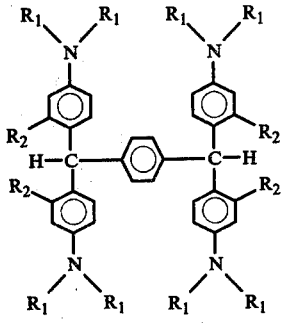

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen, said photoconductive material exhibiting the capability of photogeneration of holes and injection of said holes and said charge transport layer being substantially non-absorbing in the spectral region at which the photoconductive material generates and injects photogenerated holes but being capable of supporting the injection of photogenerated holes from said photoconductive material and transporting said holes through said charge transport layer;

(c) imagewise exposing said charged member to a source of activating radiation to which the photoconductive material is absorbing and to which the charge transport layer is non-absorbing, wherein the photogenerated holes generated by said photoconductive material are injected into and are transport through said charge transport layer to form a latent electrostatic image on the surface of said member.

52. An imaging member comprising a charge generation layer consisting essentially of an amorphous mixture of selenium, arsenic and a halogen, arsenic is present in amounts from about 0.5 percent to about 50 percent by weight and the halogen is present in amounts from about 10 to about 10,000 parts per million with the balance being selenium and a contiguous charge transport layer of electrically inactive organic resinous material having dispersed therein from about 10 to about 75 percent by weight of

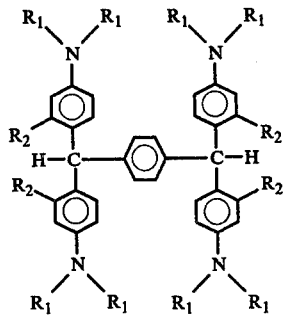

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen, said charge generation layer exhibiting the capability of photogeneration of holes and injection of said holes and said charge transport layer being substantially non-absorbing in the spectral region at which the charge generation layer generates and injects photogenerated holes but being capable of supporting the injection of photogenerated holes from said charge generation layer and transporting said holes through said charge transport layer.

53. The member according to claim 52 wherein the arsenic is present in amounts from 20 percent to about 40 percent by weight.

54. The member according to claim 52 wherein the halogen is iodine.

55. The member according to claim 52 wherein the generation layer consists essentially of 64.5 percent by weight selenium, 35.5 percent by weight arsenic and 850 parts per million iodine.

56. An imaging member comprising a charge generation layer consisting essentially of particulate amorphous material consisting essentially of selenium, arsenic and a halogen, arsenic is present in amounts from about 0.5 percent to about 50 percent by weight and the halogen is present in amounts from about 10 to about 10,000 parts per million with the balance being amorphous selenium, said particulate material dispersed in a resinous binder and a contiguous charge transport layer of electrically inactive organic resinous material having dispersed therein from about 10 to about 75 percent by weight of

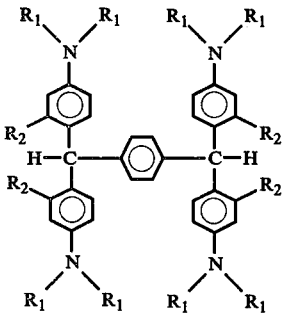

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen, said charge generation layer exhibiting the capability of photogeneration of holes and injection of said holes and said charge transport layer being substantially non-absorbing in the spectral region at which the charge generation layer generates and injects photogenerated holes but being capable of supporting the injection of photogenerated holes from said charge generation layer and transporting said holes through said charge transport layer.

57. The member according to claim 56 wherein the arsenic is present in amounts from about 20 percent to about 40 percent by weight.

58. The member according to claim 56 wherein the halogen is iodine.

59. The member according to claim 56 wherein the generation layer consists essentially of 64.5 percent by weight selenium, 35.5 percent by weight arsenic and 850 parts per million iodine.

60. A method of imaging which comprises:

(a) providing an imaging member consisting essentially of a charge generation layer consisting essentially of an amorphous mixture of selenium, arsenic and a halogen, arsenic is present in amounts from about 0.5 percent to 50 percent by weight and the halogen content being from about 10 to about 10,000 parts per million with the balance being selenium and a contiguous charge transport layer consisting essentially of electrically inactive organic resinous material having dispersed therein from about 10 to about 75 percent by weight of

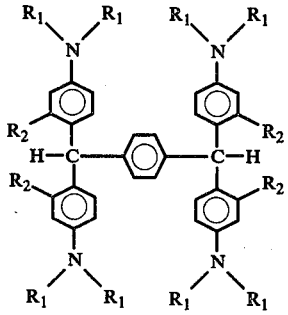

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen, said photoconductive material exhibiting the capability of photogeneration of holes and injection of said holes and said charge transport layer being substantially non-absorbing in the spectral region at which the photoconductive material generates and injects photogenerated holes but being capable of supporting the injection of photogenerated holes from said photoconductive material and transporting said holes through said charge transport layer;

(b) uniformly electrostatically charging said member, followed by;

(c) imagewise exposing said charged member to a source of activating radiation to which the photoconductive material is absorbing and to which the charge transport layer is non-absorbing, wherein the photogenerated holes generated by said photoconductive material are injected into and are transported through said charge transport layer to form a latent electrostatic image on the surface of said member.

61. A method of imaging which comprises:

(a) providing an imaging member comprising a charge generation layer consisting essentially of particulate amorphous material consisting essentially of selenium, arsenic and a halogen, the arsenic content being from about 0.5 percent to about 50 percent by weight and the halogen content being from about 10 to about 10,000 parts per million with the balance being selenium, said particulate material dispersed in a resinous binder and a contiguous charge transport layer consisting essentially of electrically inactive organic resinous material having dispersed therein from about 10 to about 75 percent by weight of

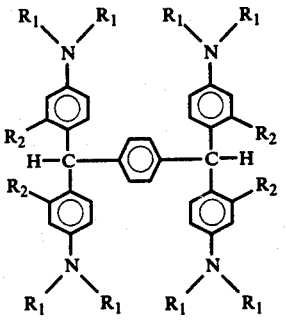

where $R_1$ is selected from the group consisting of an alkyl with from 1 to 12 carbon atoms and an alkyl with from 1 to 12 carbon atoms substituted by aryl groups selected from the group consisting of phenyl, naphthyl, anthryl, and biphenyl and $R_2$ is selected from the group consisting of methyl, ethyl, chloro, bromo and hydrogen, said charge generation material exhibiting the capability of photo-excited hole generation and injection and said charge transport layer being substantially non-absorbing in the spectral region at which the charge generation material generates and injects photo-excited holes but being capable of supporting the injection of photo-excited holes from said charge generation material and transporting said holes through said charge transport layer;

(b) uniformly electrostatically charging said member, followed by;

(c) imagewise exposing said charged member to a source of activating radiation to which the photoconductive material is absorbing and to which the charge transport layer is non-absorbing, wherein the photogenerated holes generated by said photoconductive material are injected into and are transport through said charge transport layer to form a latent electrostatic image on the surface of said member.

* * * * *